US005611189A

United States Patent [19]

Fleck

[11] Patent Number: 5,611,189

[45] Date of Patent: Mar. 18, 1997

[54] APPARATUS FOR HANGING FASCIA BOARD

[76] Inventor: Randy J. Fleck, 95 S. 132 St., Chandler, Ariz. 85225

[21] Appl. No.: 375,991

[22] Filed: Jan. 20, 1995

[51] Int. Cl.[6] ..... B25B 11/02

[52] U.S. Cl. ..... 52/702; 52/93.2; 52/94; 52/126.3; 33/406; 33/838; 269/41; 269/60; 269/904

[58] Field of Search ..... 52/93.2, 94, 126.1, 52/126.3, 126.4, 702; 33/406, 451, 838, 533, 549, 573; 269/904, 41, 60

[56] References Cited

U.S. PATENT DOCUMENTS 4,164,346 8/1979 Sickler ..... 269/904 X
4,718,628 1/1988 Vitta ..... 52/126.1 X
4,836,517 6/1989 Vossler ..... 269/904 X
5,192,059 3/1993 Silver ..... 269/904 X

*Primary Examiner*—Christopher T. Kent
*Attorney, Agent, or Firm*—Banner & Witcoff, Ltd.

[57] ABSTRACT

A hanger for holding and supporting fascia board during installation along the rafters of a roof. The hanger is formed of a saddle or bracket which attaches to the upper edge of the rafter. A fascia catch is pivotally attached to the saddle through an adjusting bar. The catch can be adjusted along the adjusting bar as needed and then locked in place.

15 Claims, 7 Drawing Sheets

APPARATUS FOR HANGING FASCIA BOARD

BACKGROUND OF THE INVENTION

The present invention generally relates to the field of craftsman's tools and fixtures, and more particularly, is directed to a fascia hanger for assisting a workman in installing fascia board.

In many of the construction trades, the economies of modern construction necessitates that the number of craftsmen be limited to as few as possible due to high labor cost. Labor cost are particularly high in the construction industry which, by necessity, is labor intensive because few construction practices can be reduced to automated techniques. The advances in modern construction practices have been, for the most part, in improvements in the operation and efficiency of everyday tools that craftsmen use. For example, the development of automatic nailing guns, super adhesives, and tools to apply them, and better materials and prefabricated substructures have greatly improved the efficiency and speed of building construction.

Much of the improvements in the past, however, have been directed toward improving the efficiency of the individual craftsman. There remains, however, much needed improvements in overall construction practices which will lead to a reduction in the number of needed craftsmen, and thus, a corresponding reduction in construction cost. One such area is the hanging of fascia board to the ends of rafters during the construction of a home, which in he past has been a two or three-man job.

In conventional home construction, the rafters slant downward from the peak of the roof to the upper edge of the wall. Boards are laid on the upper surface of the rafters to form the roof. The rafters and roof extend beyond the wall and eave troughs at the edge of the roof receive the rain runoff from the roof. The eave troughs are mounted on fascia boards fastened to the ends of the rafters and lay parallel to the wall of the house.

In order to provide a flat surface for the fascia board to attach, the ends of the rafters are often cut parallel to the wall of the house. Such a practice requires an angular cut through the rafters which involves a considerable amount of time and resulting expense. An alternative practice has been to nail the fascia board to the upper edge of the squared ends of the rafters or to the roof boards. This approach, however, is a less than desirable alternative because the fascia board will tend to separate from the rafters due to accumulations of ice, snow, wet leaves and the like because of the poor connection of the fascia board. Thus, a number of devices are known in the prior art which attempt to overcome these problems by attaching to the rafter edge and providing a suitable surface for attachment of the fascia board. One such device is the fascia board support disclosed in U.S. Pat. No. 4,148,164. The support forms and shapes the ends of the rafters in order to accommodate the fascia board.

While such devices represent an improvement in the attachment of fascia board, they leave unresolved the costly and labor intensive efforts required in the hanging of such boards.

SUMMARY OF THE INVENTION

It is the overall object of the present invention to provide a fascia hanger which greatly facilitates the hanging of fascia board along the edges of rafters.

It is a specific object of the present invention to provide a fascia hanger which is easy to install and use.

It is another specific object of the present invention to provide a fascia hanger which is low in cost while at the same time being sturdy in construction.

It is another object of the present invention to provide a fascia hanger which enables one worker to install fascia board along the ends of rafters.

It is still another object of the present invention to provide a fascia hanger that allows the relative height of fascia to the top of the rafter to be fully adjustable during the installation process.

These and other objects of the present invention are achieved by a fascia hanger which is formed of a saddle or bracket which attaches to the upper edge of a rafter. A fascia catch is pivotally attached to the saddle through an adjusting bar. The catch can be adjusted along the adjusting bar as needed and then be locked in place. By installing a plurality of hangers at spaced rafter positions, the fascia board can be held in place, allowing its installation by one worker.

DETAILED DESCRIPTION OF THE PREFERRED EMBODIMENT

Figure 1:
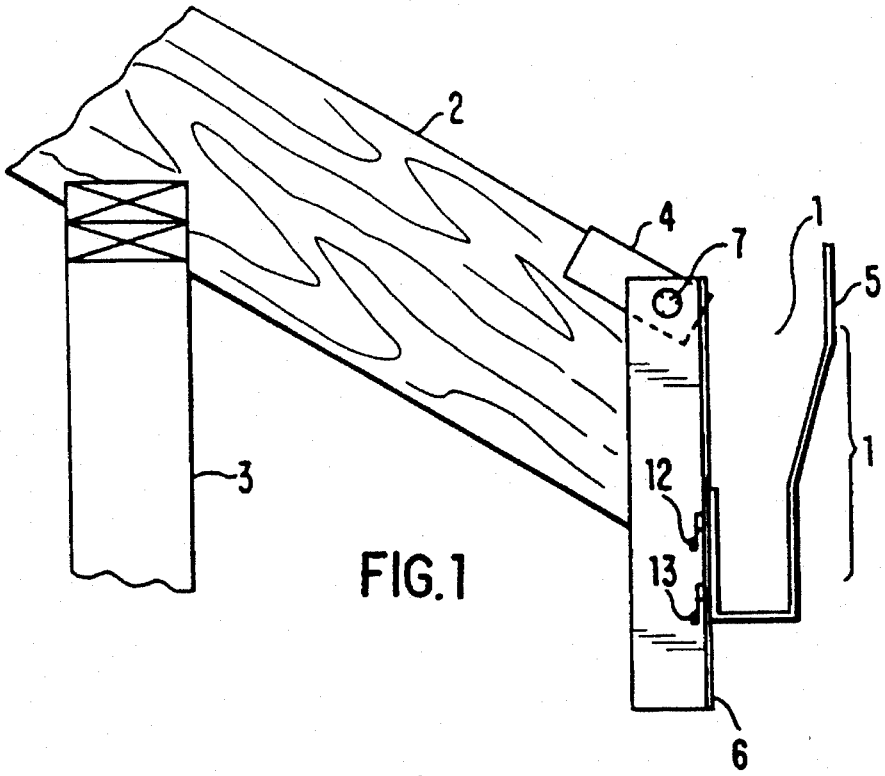
FIG. 1 is an elevational view showing one embodiment of the fascia hanger of Applicant's invention attached to a rafter.

The fascia hanger of Applicant's invention will now be described with reference to the drawings. FIG. 1 illustrates one embodiment of Applicant's fascia hanger, which is generally indicated by reference No. 1, and is shown connected to rafter 2. As in the case of a home, rafter 2 extends beyond exterior wall 3 at a conventional angle for a conventional length. The hanger is attached to rafter 2 with a saddle or bracket 4. A holder portion 5 of the hanger swivels about pivot point 7 in accordance with the end cut of rafter 2.

Figure 2:
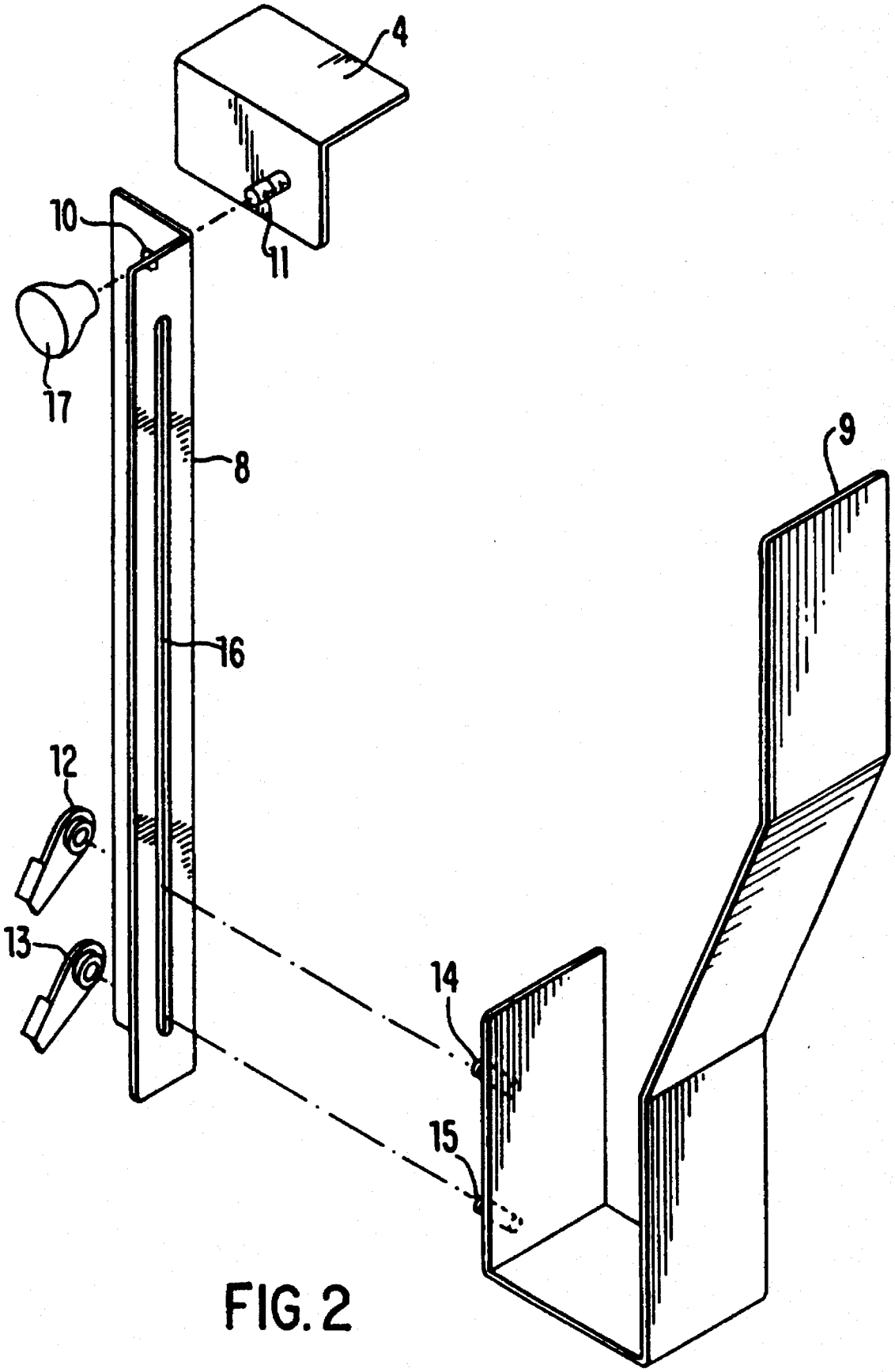
FIG. 2 is a perspective view of Applicant's fascia hanger of FIG. 1 illustrating the various components and their relation to each other.

FIG. 2 illustrates assembly of the major components of Applicants fascia hanger. As shown in the drawing, holder 5 is formed of adjusting channel 8 and catch 9. Catch 9 is attached to channel 8 with studs 14 and 15 which are attached to catch 9 and secured to respective cinching levers 12 and 13 through slot 16 formed in channel 8. The relative position of catch 9 with respect to channel 8 can be changed by releasing cinching levers 12 and 13 and moving catch 9 along slot 16. Catch 9 can then be secured in the relocated position by cinching levers 12 and 13.

Bracket 4 is attached to channel 8 by hand knob 17. Knob 17 is internally threaded to receive stud 11 attached to bracket 4 through hole 10 formed in adjusting channel 8. Knob 17 also may be replaced by a nut and washer combination. Ideally, the size of the nut will correspond to the tools and wrenches which craftsmen normally carry.

Figure 3:
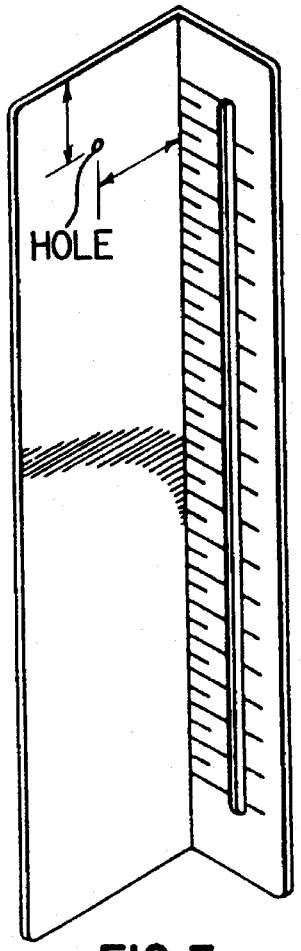
FIG. 3 is an elevational view of the adjusting channel of Applicant's fascia hanger of FIG. 1 illustrating the graduated scale used to adjust the position of the catch.

Slot 16 in channel 8 is marked with a graduated scale in increments of inches and fraction of inches as shown in FIG. 3. The graduations permit catch 9 to be repeatedly set to different positions accurately. Where two or more fascia hangers are used to hang fascia board, the graduated scale allows the catches in each hanger to be set to the same relative position with respect to channel 8.

Figure 5:
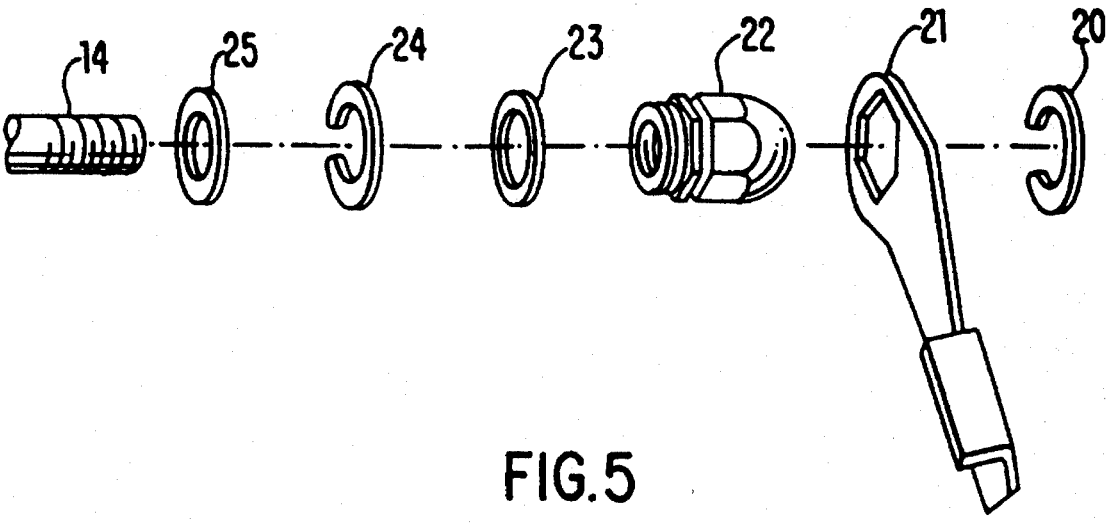
FIG. 5 is an assembly view showing the various components used to connect the catch to the adjusting channel in Applicant's fascia hanger of FIG. 1.

FIG. 5 illustrates the various components which are used to form cinching levers 12 and 13. The components include retaining ring 20, lever 21, acorn nut 22, stop washer 23, retainer ring 24 and washer 25. Studs 14 and 15 are threadedly received in acorn nut 22 which is tightened by lever 21 to thereby hold catch 9 in rigid connection with channel 8. Cinching levers 12 and 13 also may be replaced by nut and washer combinations as discussed above with respect to knob 17.

Figure 4:
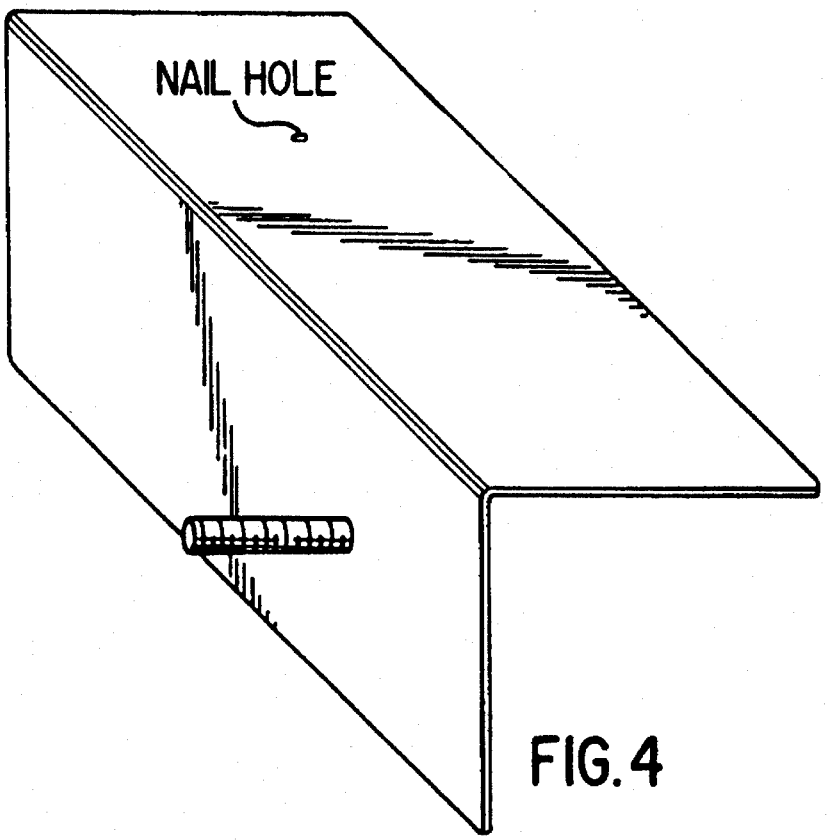
FIG. 4 is a perspective view of the saddle used in Applicant's fascia hanger of FIG. 1.
Figure 6:
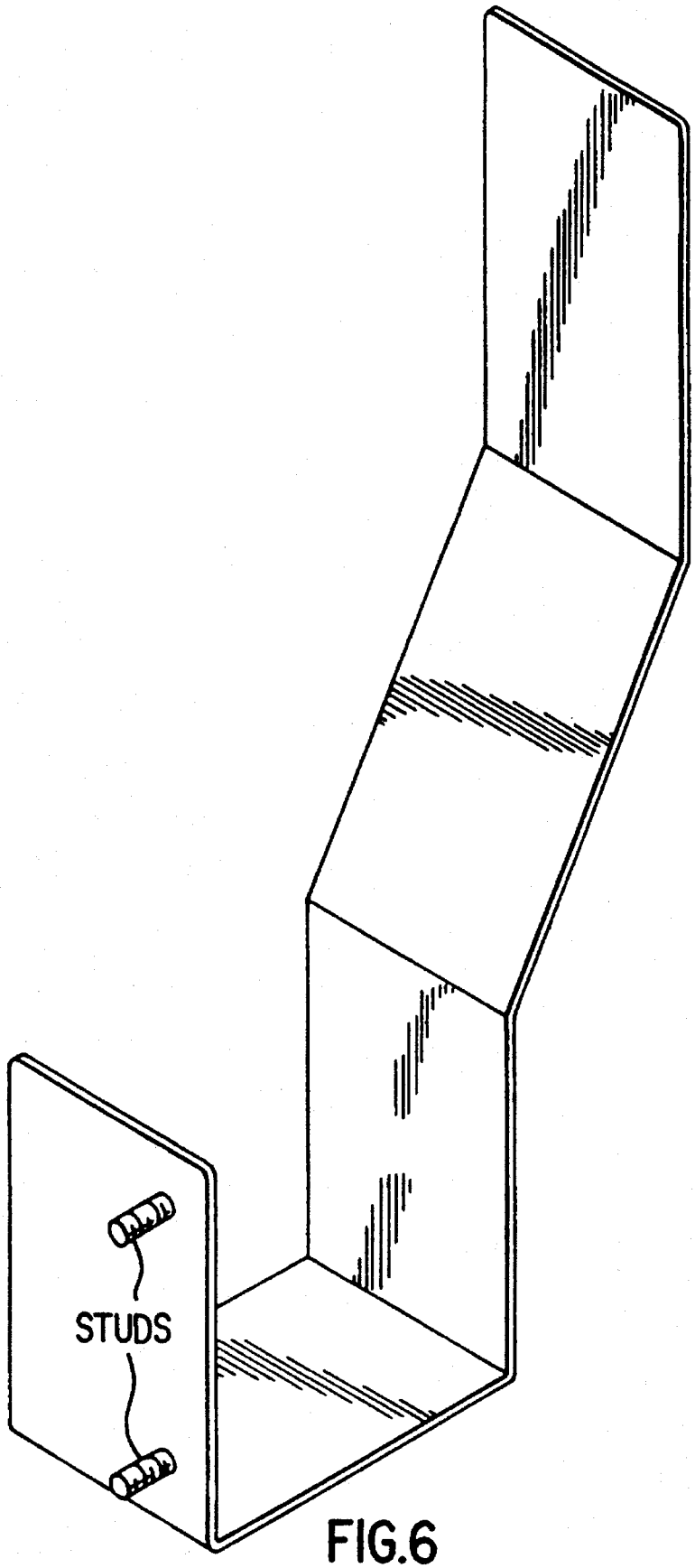
FIG. 6 is a perspective view of a portion of Applicant's hanger of FIG. 1 showing various dimensions which have been found to be ideal for typical uses of the hanger.

The fascia hanger of Applicant's invention can be fabricated from a variety of materials. It has been found that ⅛" thick 1018 steel provides the ideal strength while at the same time being light in weight. Other dimensional consideration, such as the height and width of catch 9, will depend on the size of fascia board that the hanger is intended to be used to hang. Applicant has found that the dimensions shown in FIGS. 4 and 6 accommodate typical fascia hanging jobs.

As shown in the drawings, the outer side of catch 9 is outwardly angled to provide a funnel effect. It has been found that angling the outer edge in this manner eases the placing of fascia board into catch 9. It is not absolutely necessary, however, that the outer edge be angled in order to practice the inventive features of Applicant's invention. The outer side may also be made substantially straight.

Figure 7:
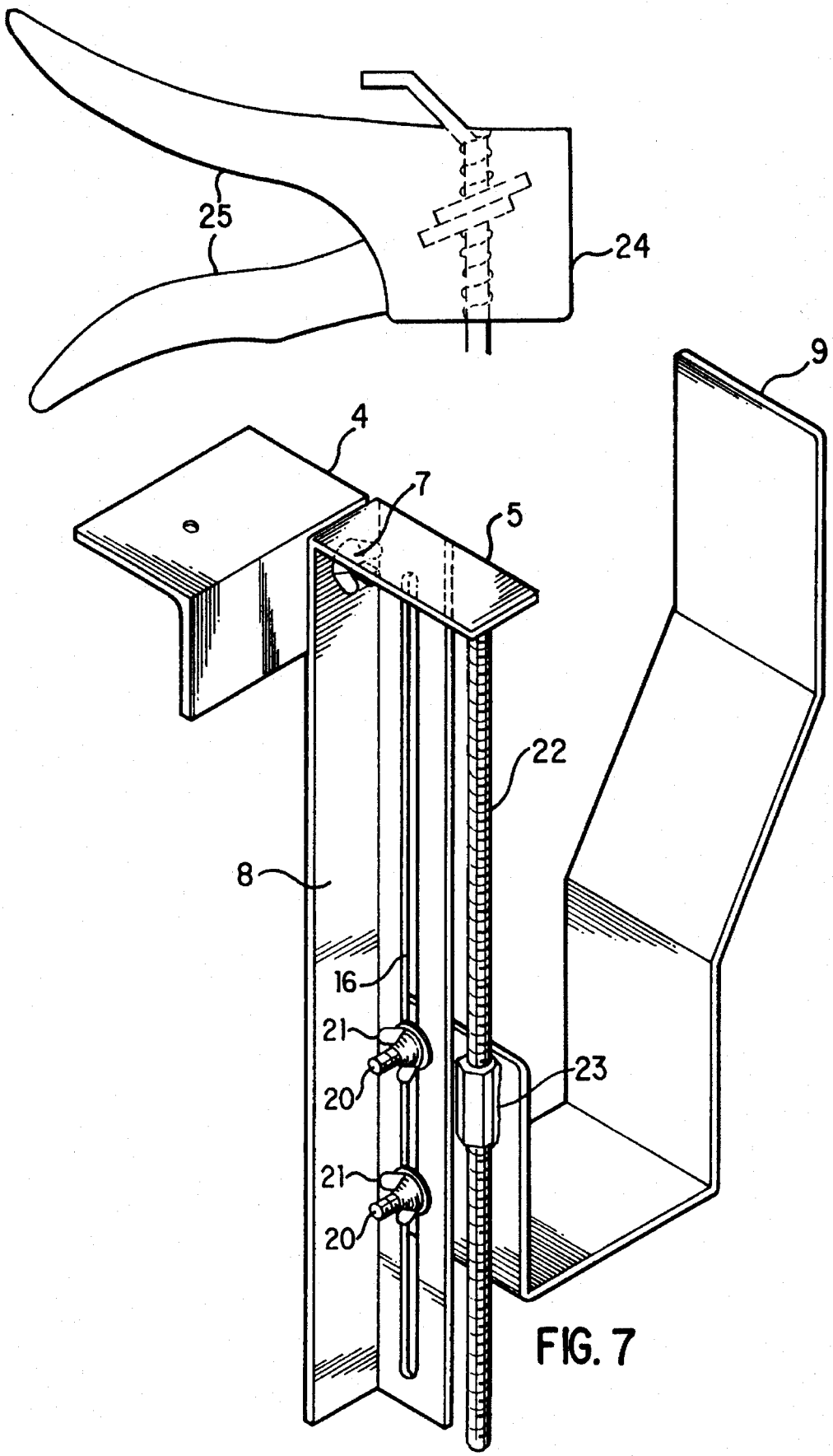
FIG. 7 is an elevational view showing another embodiment of the fascia hanger of Applicant's invention.

FIG. 7 illustrates another embodiment of Applicants fascia hanger. As shown in the drawing, holder 5 is formed of adjusting channel 8 and catch 9. Catch 9 is attached to channel 8 with bolts 20 and corresponding wing nuts 21. Catch 9 also is attached to ratchet rod 22 through ratchet collar 23. A ratchet device 24 is mounted on top of holder 5 and receives racket rod 22. Ratchet device 24 has a pair of handles 25. When the position of catch 9 needs to be relocated, handles 25 can be used to adjust the vertical position of ratchet rod 24 and thus the relative position of catch 9 with respect to channel 8. Catch 9 can then be secured in its new location by bolts 20 and corresponding wing nuts 21 through slot 16.

Figure 8:
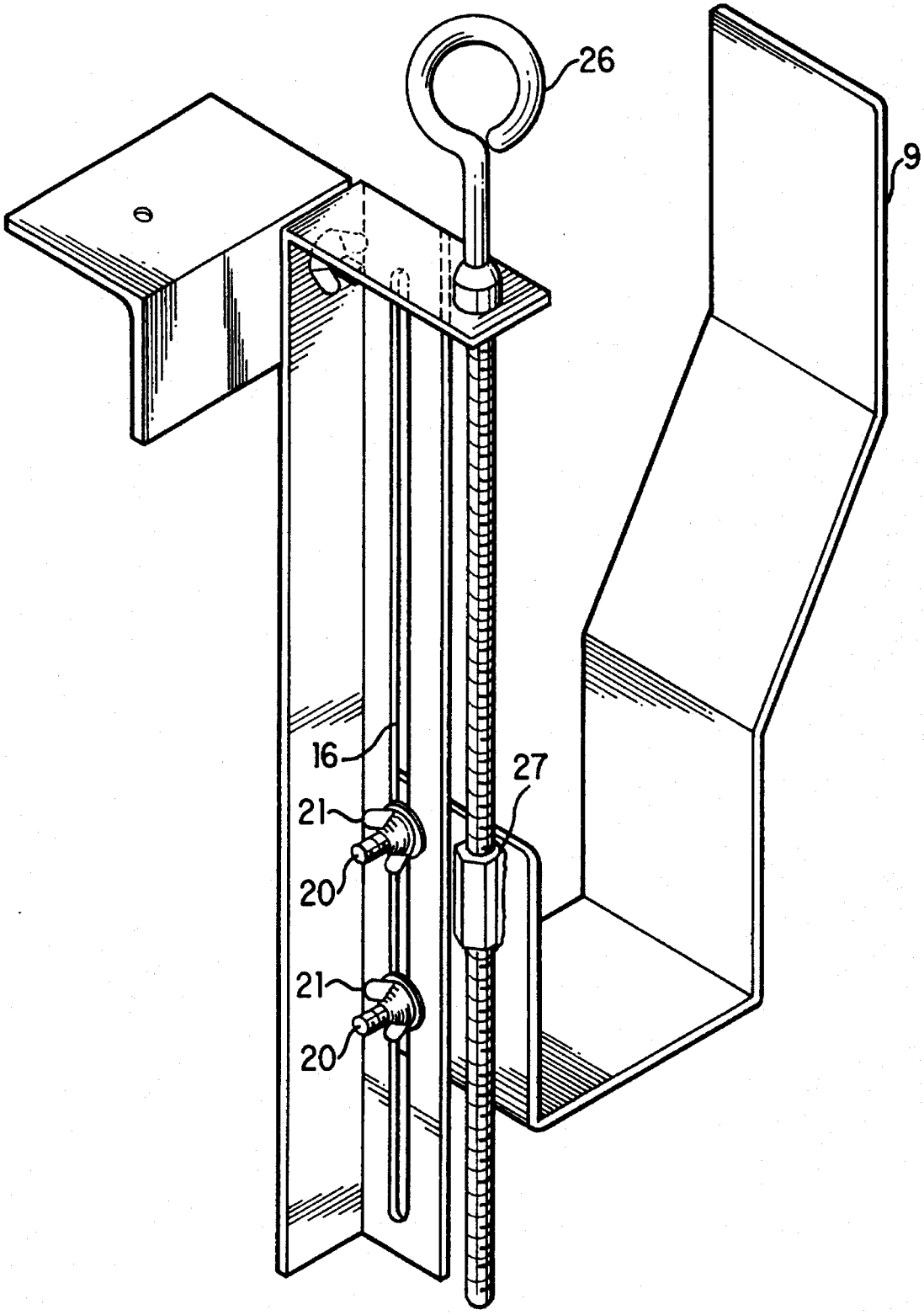
FIG. 8 is an elevational view showing a further embodiment of the fascia hanger of Applicant's invention.

FIG. 8 illustrates still further embodiment of Applicants fascia hanger. In this embodiment, catch 9 is attached to eye-bolt 26 through threaded collar 27. The vertical position of catch 9 can be adjusted by eye-bolt 26. Once adjusted, catch 9 can be secured in its new location by bolts 20 and corresponding wing nuts 21 through slot 16.

Figures 9, 10:
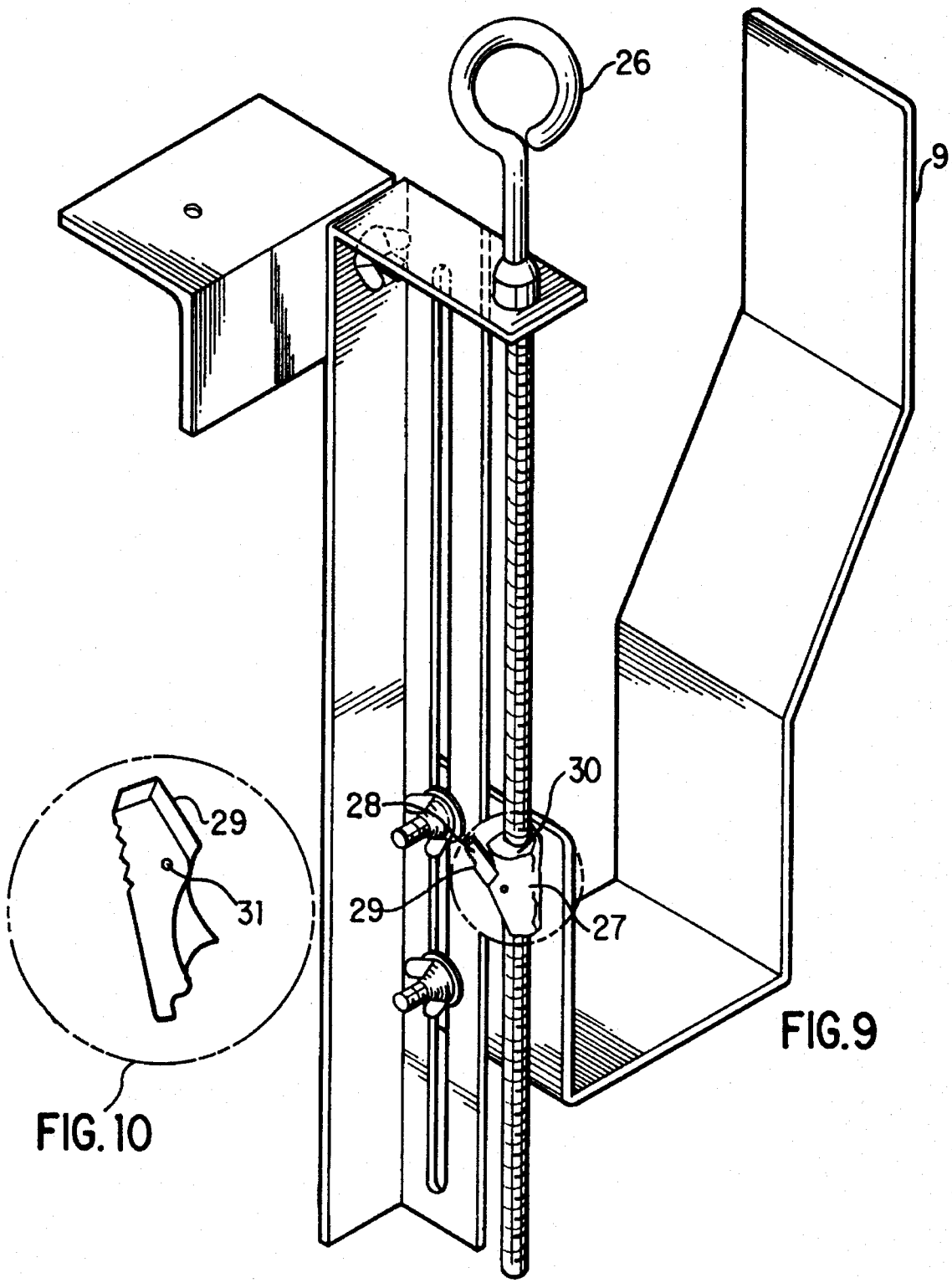
FIGS. 9 and 10 illustrate a still further embodiment of the fascia hanger of Applicant's invention.

FIGS. 9 and 10 illustrate another embodiment of the present invention. In this embodiment, collar 27 includes a quick release mechanism 28 which, when released, allows catch 9 to be easily moved along eye-bolt 26 to the desired vertical position.

Release mechanism 28, which is further illustrated in FIG. 10, includes a pivot arm 29 which pivots about a pivot pin 31 and a spring 30 which normally holds pivot arm 29 in an engaged position with respect to eye-bolt 26. The mechanism is released by pushing pivot arm 29 toward eye-bolt 26.

Applicant's hanger has application beyond the hanging of fascia board. For example, it may be used to assist in the routing of long water pipes and electrical conduit. Any suitable temporary attachment point for saddle 4 may be used to see the hanger to a structure to which pipes or other elongated elements are to be attached. The hanger may also be used as a temporary holder for electrical cables during their initial routing until they can be permanently secured in place. Holding of light duty scaffolding bars and work and material rests also represent potential uses of Applicant's hanger.

Although an illustrative embodiment of the present invention has been described in detail with reference to the accompanying drawings, it is to be understood that the invention is not limited to the precise embodiment shown and that various changes or modifications may be effected therein by one skilled in the art without departing from the scope or spirit of the invention.

I claim:

1. A hanger for holding and supporting an object adjacent a structure to which said object is to be attached, said hanger comprising:

saddle means for attaching said hanger to said structure, said saddle means being formed of bracket means adapted for attachment to said structure and pivot means pivotally connected to said bracket means;

holder means connected to said saddle means for holding and supporting said object; and adjustment means for adjusting the position of said holder means with respect to said saddle means, said adjustment being in a generally vertical direction.

2. The hanger of claim 1 wherein said adjustment means includes a ratchet rod and ratchet means for adjusting the position of said holder means.

3. The hanger of claim 2 wherein said holder means is attached to said ratchet rod.

4. The hanger of claim 2 wherein said adjustment means includes a threaded rod for adjusting the position of said ratchet rod.

5. The hanger of claim 4 wherein said holder means is attached to said ratchet rod.

6. The hanger of claim 1 wherein said holder means is substantially U-shaped in construction and having an outer side, an inner side and a bottom side.

7. The hanger of claim 6 wherein said inner side is pivotally connected to said saddle means and has an elongated slot, the portion of said holder means formed by said outer and bottom sides being connected to said inner side by fastening means through said slot for rigidly holding said outer and bottom sides in a predetermined position with respect to said inner side.

8. The hanger of claim 7 wherein said slot includes a graduated reference scale for positioning said outer and bottom sides to predetermined positions along said slot.

9. The hanger of claim 6 wherein said outer and bottom sides are connected to said inner side by fastener means formed of a threaded stud rigidly attached to said outer and bottom sides and to a corresponding cinching lever.

10. A hanger for holding and supporting an object adjacent a structure to which said object is to be attached, said hanger comprising:

saddle means or attaching said hanger to said structure, wherein said saddle means may be readily assembled and disassembled by hand from a holder means;

holder means pivotally connected to said saddle means for holding and supporting said object;

adjustment means for adjusting the position of said holder means with respect to said saddle means; and fastener means for connecting said saddle means to said holder means, said fastener means being formed of a threaded stud rigidly attached to said saddle means and a hand knob internally threaded to receive said stud, said stud passing through a hole formed in said holder means and into engagement with said hand knob.

11. A hanger for holding and supporting an object adjacent a structure to which said object is to be attached, said hanger comprising:

saddle means for attaching said hanger to said structure;

holder means pivotally connected to said saddle means for holding and supporting said object; and adjustment means for adjusting the position of said holder means with respect to said saddle means, wherein said adjustment means includes an eye-bolt for adjusting the position of said holder means.

12. The hanger of claim 11 wherein said holder means is attached to said eye-bolt.

13. The hanger of claim 12 wherein said holder means is substantially U-shaped in construction and having an outer side, an inner side and a bottom side.

14. The hanger of claim 12 wherein said holder means is attached to said eye-bolt via a threaded collar.

15. The hanger of claim 14 herein said collar includes a quick release mechanism for said holder means.

* * * * *